US010612730B1

(12) United States Patent
Pu et al.

(10) Patent No.: US 10,612,730 B1
(45) Date of Patent: Apr. 7, 2020

(54) U-SHAPED LED TUBE

(71) Applicant: CH LIGHTING TECHNOLOGY CO., LTD., Shaoxing, Zhejiang Province (CN)

(72) Inventors: Jizhong Pu, Shaoxing (CN); Jiejiang Guo, Shaoxing (CN); Caiying Gan, Shaoxing (CN)

(73) Assignee: CH LIGHTING TECHNOLOGY CO., LTD., Shaoxing (CN)

( * ) Notice: Subject to any disclaimer, the term of this patent is extended or adjusted under 35 U.S.C. 154(b) by 0 days.

(21) Appl. No.: 16/361,734

(22) Filed: Mar. 22, 2019

(30) Foreign Application Priority Data

Dec. 27, 2018 (CN) ..... 2018 2 2223244 U

(51) Int. Cl.

| | |
|---|---|
| ***F21K 9/275*** | (2016.01) |
| ***F21K 9/272*** | (2016.01) |
| ***F21Y 115/10*** | (2016.01) |
| ***F21Y 103/37*** | (2016.01) |

(52) U.S. Cl.
CPC ..... *F21K 9/275* (2016.08); *F21K 9/272* (2016.08); *F21Y 2103/37* (2016.08); *F21Y 2115/10* (2016.08)

(58) Field of Classification Search
CPC ..... F21V 17/101; F21K 9/275; F21K 9/272; F21Y 2103/37; F21Y 2115/10
See application file for complete search history.

(56) References Cited

U.S. PATENT DOCUMENTS

| | | | | |
|---|---|---|---|---|
| 10,088,142 | B1 * | 10/2018 | McGrath | F21V 31/005 |
| 2011/0317418 | A1 * | 12/2011 | Burrell, IV | F21V 19/0045 362/241 |
| 2013/0235570 | A1 * | 9/2013 | Hood | F21V 21/00 362/225 |
| 2015/0070885 | A1 * | 3/2015 | Petro | F21V 3/02 362/223 |
| 2017/0268759 | A1 * | 9/2017 | Yao | F21V 3/061 |

* cited by examiner

*Primary Examiner* — Mary Ellen Bowman
(74) *Attorney, Agent, or Firm* — Jiwen Chen

(57) ABSTRACT

The present invention discloses a U-shape LED tube, comprising a U-shape tube body and light bars fixed inside the U-shape tube body. The U-shape tube body comprises two straight tube sections and one curved section, the curved section comprises two semicircle tubes, the two ends of the curved section are provided with shrinkage parts that are inserted in the straight tube sections, and the shrinkage parts are in fixed connection with the straight tube sections through ultrasonic welding. The curved section of the present invention is provided with shrinkage parts that are inserted in the straight tube sections, the outer diameters of the tubes of each part are consistent, achieving streamline aesthetic appearance; the shortcomings of tube body corrosion and light emission blockage due to fixing of light bar with adhesive glue in conventional LED tube are overcome through ultrasonic welding.

10 Claims, 4 Drawing Sheets

U-SHAPED LED TUBE

This application claims the priority benefit of Chinese Application No. 201822223244.2, filed Dec. 27, 2018, which is hereby incorporated by reference.

TECHNICAL FIELD

The present invention relates to an LED light tube, especially relates to a U-shape LED light tube that is convenient to assemble.

BACKGROUND ART

Comparing to conventional fluorescent tube, LED tubes have advantages of energy saving, environment friendliness and long service life etc. Therefore, it has become the development trend in the lighting industry to replace traditional fluorescent tube with a LED tube. Most LED tubes in the prior art comprise three parts: a tube body, a light bar and a lamp holder, wherein the light bar is fixed in the tube body through adhesive glue or mechanical snap-in groove, and the lamp holder is fixed at the two ends of the lamp holder through bonding.

Generally, the light bar is integrated. In terms of traditional straight tube etc., it is not difficult to assemble. However, as far as U-shape tube is concerned, it is much difficult to assemble. To solve the problem, Chinese patent CN204534210U has provided a U-shape LED tube, comprising: a U-shape tube, a LED light source component, a heat sink, a driver and a lamp holder. The U-shape tube comprises two straight tube sections and a U-shape curved section. The two straight tube sections and the U-shape curved section are in separated construction. The U-shape curved section comprises a first semicircle part and a second semicircle part. The first semicircle part and the second semicircle part fit with each other to form a member containing a U-shaped cavity, and the lamp panel is in U-shape, comprising two straight panel sections respectively in the two straight tube sections and a U-shape panel section in the member containing a U-shaped cavity.

The elbow or curved section in the U-shape LED tube disclosed by the above-mentioned patent has an expansion part, the straight tube section is inserted into the elbow section, resulting in an expanded node at the connection point of the tube, hence the appearance is not aesthetic. In addition, the first semicircle part and the second semicircle part are in snap-in connection. Under the effect of external force, the two parts can get separated easily.

SUMMARY OF THE INVENTION

The present invention provides a U-shape LED tube, which overcomes the problem of poor aesthetic appearance and low strength elbow in the prior art.

A U-shape LED tube, comprising a U-shape tube body and light bars fixed inside the U-shape tube body, the U-shape tube body comprises two straight tube sections and one curved section, the curved section comprises two semicircle tubes, the two ends of the curved section are provided with shrinkage parts that are inserted in the straight tube sections, and the shrinkage parts are in fixed connection with the straight tube sections through ultrasonic welding.

The tube body is made of plastics such as PC (polycarbonates). Under the effect of external force, the two semicircle tubes can split easily. To solve the problem and improve the tube strength, the two semicircle tubes are connected through ultrasonic welding.

The light bar can be directly fixed in the U-shape tube body through adhesive glue or snap-in groove. Due to the corrosiveness of the adhesive glue that corrodes the tube body, as optimum solution, snap-in groove that fits the edge of the light bar and fixes the light bar is provided inside the straight tube section.

The snap-in groove can be directly arranged on the inner wall of the tube body (but the strength of the tube body can be reduced) or can be arranged on the reinforcing rib in the tube body (but it is inconvenient to assemble), the optimum solution is to provide extended fastening strip in the length direction on the inner wall of the straight tube section, and the snap-in groove is formed by the fastening strip together with the inner wall of the straight tube section.

In order to allow the shrinkage part to be inserted into the straight tube section, the shrinkage section is provided with a notch for avoiding the fastening strip, when assembling, the fastening strip is inserted into the notch.

Preferably, the curved section is provided with a stop block to fix the light bar, and the light bar is held down by the stop block to avoid the light bar in the curved section from shaking.

In order to realize sealed fitting of the two semicircle tubes, step structures that snap in each other are provided at the seam between the two semicircle tubes.

A positioning mechanism comprising a positioning pin and a positioning hole is arranged between the two semicircle tubes, and it is convenient to align the two semicircle tubes when assembling with the positioning mechanism.

The U-shape LED tube comprises lamp holders that fit the two ends of the U-shape tube body, and an integrated linkage is provided between the two lamp holders to enhance the strength of the U-shape tube body.

Due to that the seam between the shrinkage part and the straight tube section is unavoidable, to avoid electric shock and increase the creepage distance, the light bar comes in integrated construction, and an inward depression or concave on the edge of the light bar is provided at the connecting point between the shrinkage part and the straight tube section.

The curved section of the present invention is provided with shrinkage parts that are inserted in the straight tube sections, and the outer diameters of the tubes of each part are consistent, achieving streamline aesthetic appearance. The shortcomings of tube body corrosion and light emission blockage due to fixing of light bar with adhesive glue in conventional LED tube are overcome through ultrasonic welding.

SPECIFIC EMBODIMENTS OF THE INVENTION

Figure 1:
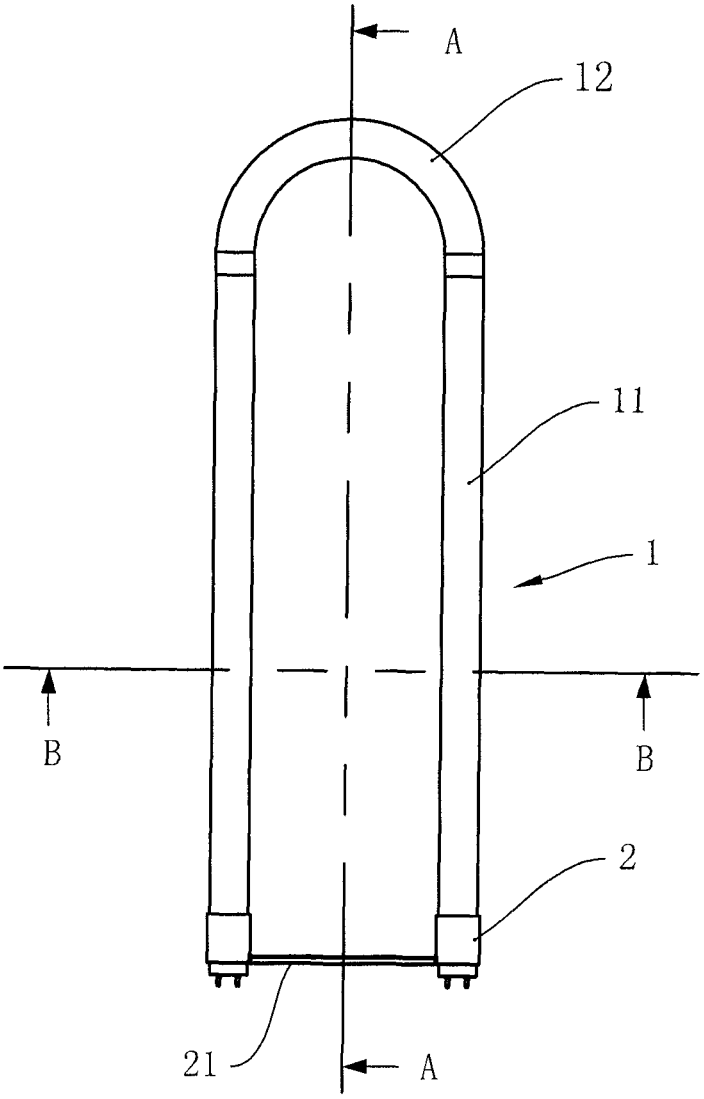
FIG. 1 is illustration of the construction of the U-shape tube of the present invention.
Figure 6:
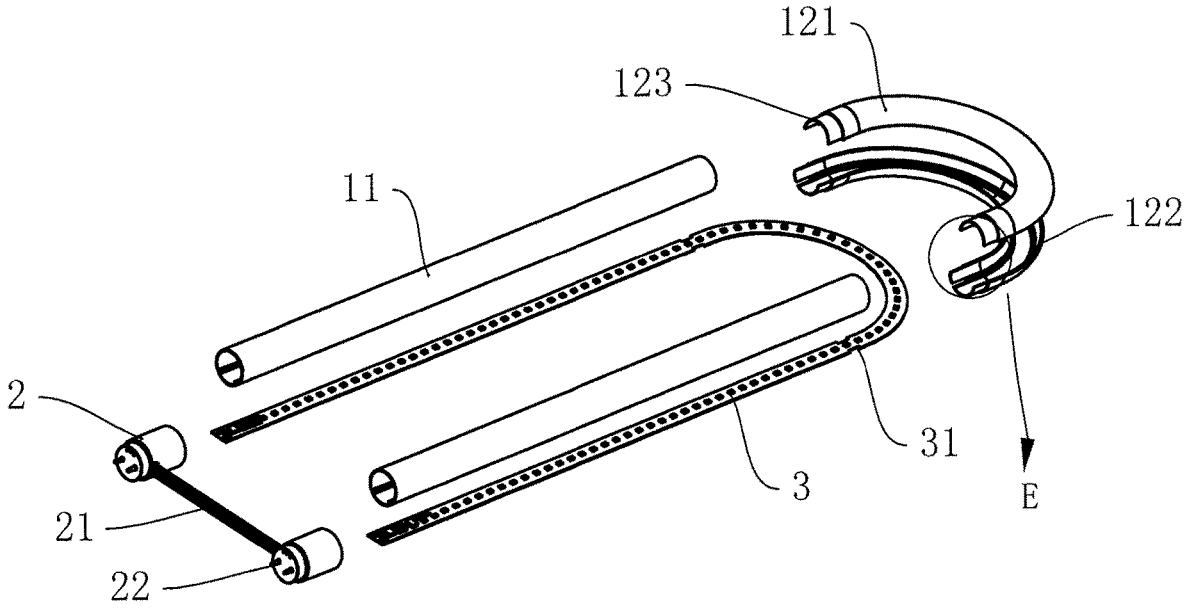
FIG. 6 is exploded view of the construction of the U-shape tube of the present invention.

As shown in FIG. 1 and FIG. 6, a U-shape tube, comprising: a U-shape tube body 1, a light bar 3 in the U-shape tube body 1 and lamp holders 2 at the two ends of the U-shape tube body 1, wherein the U-shape tube body 1 is made of plastic material, comprising two straight tube sections 11 and one curved section 12, the two ends of the curved section 12 are provided with shrinkage part 125 that is inserted into the straight tube section 11, the outer diameter of the shrinkage part 125 is slightly less than that of the straight tube section 11, the inner diameter is the same as that of the straight tube section 11, it is in fixed connection with the straight tube section 11 through ultrasonic welding. After connection, the overall outer diameters of the U-shape tube body 1 are even and consistent without expansion node formed at the connecting point.

Figure 2:
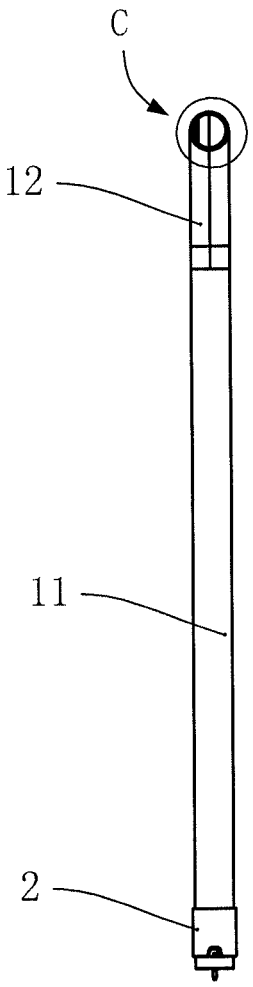
FIG. 2 is the section view of the U-shape tube illustrated in FIG. 1 in direction A-A.
Figure 3:
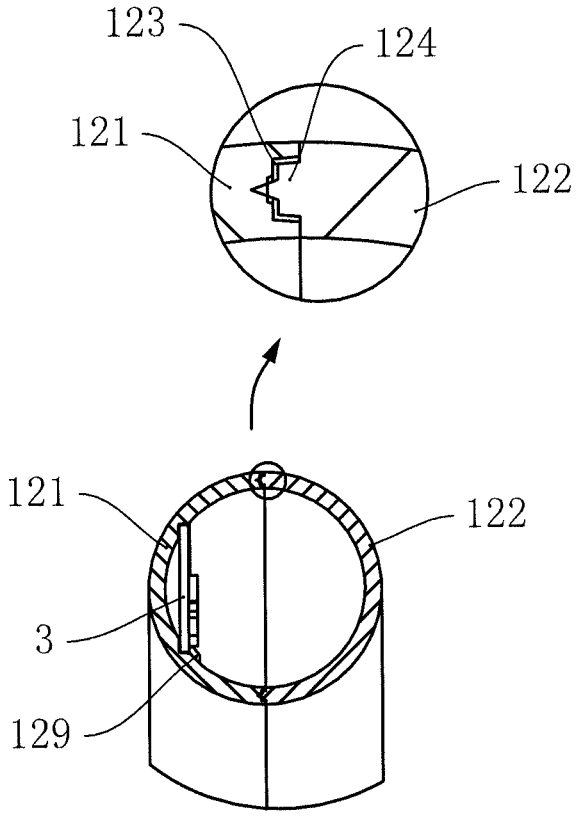
FIG. 3 is the enlarged view of C location in FIG. 2.
Figure 4:
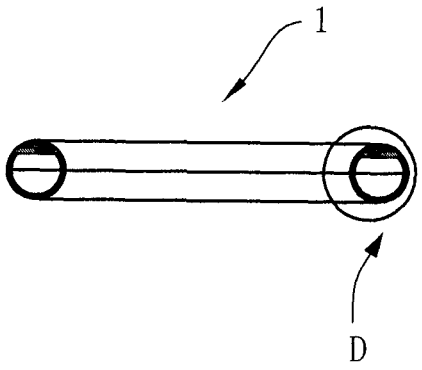
FIG. 4 is the section view of the U-shape tube illustrated in FIG. 1 in direction B-B.
Figure 5:
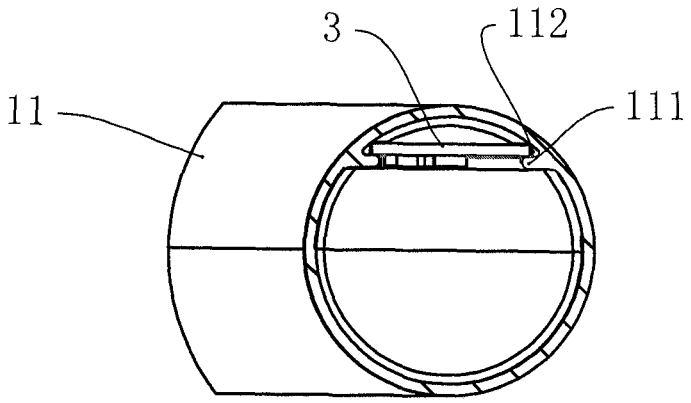
FIG. 5 is the enlarged view of D location in FIG. 4.
Figure 7:
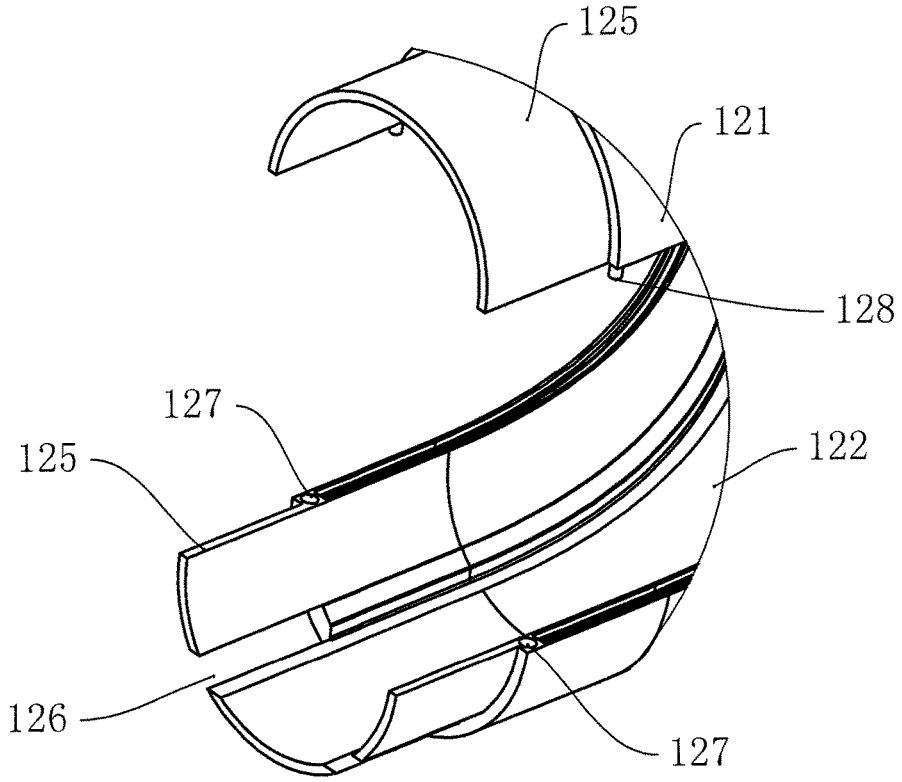
FIG. 7 is the enlarged view of E location in FIG. 6.

As shown in FIGS. 2, 3 and 6, the curved section 12 comprises a semicircle tube 121 and a semicircle tube 122; a flange 124 and a snap-in groove 123 fitting each other are provided at the seam between the two semicircle tubes, the flange 124 is inserted into the snap-in groove 123, and the two semicircle tubes are in fixed connection through ultrasonic welding. Alternatively, the flange can be formed at the semicircle tube 121, and two opposite flanges form a mutually snap-in step structure, providing sealing effect. As shown in FIG. 7, positioning hole 127 and positioning pin 128 are further provided at the seam, and the positioning or alignment hole and positioning pin constitute the positioning mechanism, through which the two semicircle tubes can be accurately aligned for easy assembly.

Light bar 3 comprises base plate and a plurality of LED beads arranged on the base plate, the base plate adopts metal base plate such as aluminum and copper materials, the base plate is further arranged with drive circuit to convert mains supply into DC power. In order to improve safety, inward depression or concave 31 at the edge of light bar 3 is provided at the connecting point between shrinkage part 125 and straight tube section 11, and depression or concave 31 can increase the creepage distance between the base plate and the tube body to improve safety.

In order to fix the light bar 3, the straight tube section 11 is provided with a fastening strip 111 extended in the length direction, the fastening strip 111 and the tube wall together form snap-in grooves 112, the spacing between the two snap-in grooves 112 is consistent with the width of the base plate, and the light bar 3 is clamped by the tube walls to prevent light bar 3 from shaking. Furthermore, to prevent the light bar 3 from shaking at the curved section, the stop block 129 is provided in the curved section 12 to fix the light bar 3, when assembling, the light bar 3 is held down by the stop block 129.

Due to that the shrinkage part 125 is inserted into the straight tube section 11, interference with the fastening strip 111 is unavoidable. To solve this problem, a notch 126 for avoiding the fastening strip 111 is provided at the shrinkage part 125. The arrangement of the snap-in grooves 112 come in multiple forms, for example, groove can be directly made on the tube wall, but this groove making method can reduce the strength of the tube body, and it is inconvenient to assemble.

The lamp holder 2 comes in a tube shape construction that fits the tube body, and it comprises two sections, wherein the section with a large inner diameter is sleeved with the tube body, and it is limited by the step between the section with a smaller inner diameter. One end of the lamp holder 3 is enclosed, and a contact pin 22 in electric connection with the light bar 3 is provided at the enclosed end. In this embodiment, an integrated linkage 21 is provided between the two lamp holders 2 to enhance the strength of the tube.

In the present invention, ultrasonic welding is adopted between the curved section 12 and the straight tube section 11, and between the two semicircle tubes of the curved section 12, through which not only the connection strength is improved, but also the technology is easy to realize.

The invention claimed is:

1. A U-shape LED tube, comprising a U-shape tube body and light bars fixed inside the U-shape tube body, the U-shape tube body comprises two straight tube sections and one curved section, and the curved section comprises two semicircle tubes, which is characterized in that: the two ends of the curved section are provided with shrinkage parts that are inserted in the straight tube sections, and the shrinkage parts are in fixed connection with the straight tube sections through ultrasonic welding;

wherein the light bar comes in integrated construction, and an inward depression or concave on the edge of the light bar is provided at the connecting point between the shrinkage part and the straight tube section;

wherein each of the two straight tube sections are in integrated construction; and wherein an outer diameter of the shrinkage part is less than that of the straight tube section, and an inner diameter of the shrinkage part is the same as that of the straight tube section.

2. The U-shape LED tube according to claim 1, which is characterized in that, the two semicircle tubes are connected with each other through ultrasonic welding.

3. The U-shape LED tube according to claim 1, which is characterized in that: the inside of the straight tube section is provided with snap-in grooves that fit the edge of the light bar and fix the light bar.

4. The U-shape LED tube according to claim 3, which is characterized in that: an inner wall of the straight tube section is provided with a fastening strip that extends along the length direction, the snap-in groove is formed by the fastening strip together with the inner wall of the straight tube section.

5. The U-shape LED tube according to claim 4, which is characterized in that: the shrinkage section is provided with a notch that avoids the fastening strip.

6. The U-shape LED tube according to claim 1, which is characterized in that: the curved section is provided with a stop block that fixes to the light bar.

7. The U-shape LED tube according to claim 1, which is characterized in that: step structures that snap in each other are provided at the seam between the two semicircle tubes.

8. The U-shape LED tube according to claim 1, which is characterized in that: a positioning mechanism comprising a positioning pin and a positioning hole is provided between the two semicircle tubes.

9. The U-shape LED tube according to claim 1, which is characterized in that: the U-shape LED tube comprises lamp holders that fit the two ends of the U-shape tube body, and an integrated linkage is provided between the two lamp holders.

10. A U-shape LED tube, comprising a U-shape tube body and light bars fixed inside the U-shape tube body, the U-shape tube body comprises two straight tube sections and one curved section, and the curved section comprises two semicircle tubes, which is characterized in that: the two ends of the curved section are provided with shrinkage parts that are inserted in the straight tube sections, and the shrinkage parts are in fixed connection with the straight tube sections through ultrasonic welding;

wherein the light bar comes in integrated construction, and an inward depression or concave on the edge of the light bar is provided at the connecting point between the shrinkage part and the straight tube section;

wherein each of the two straight tube sections are in integrated construction;

wherein an outer diameter of the shrinkage part is less than that of the straight tube section, and an inner diameter of the shrinkage part is the same as that of the straight tube section;

wherein the two semicircle tubes are connected with each other through ultrasonic welding;

wherein the inside of the straight tube section is provided with snap-in grooves that fit the edge of the light bar and fix the light bar;

wherein an inner wall of the straight tube section is provided with a fastening strip that extends along the length direction, the snap-in groove is formed by the fastening strip together with the inner wall of the straight tube section;

wherein the shrinkage section is provided with a notch that avoids the fastening strip;

wherein the curved section is provided with a stop block that fixes to the light bar;

wherein step structures that snap in each other are provided at the seam between the two semicircle tubes;

wherein a positioning mechanism comprising a positioning pin and a positioning hole is provided between the two semicircle tubes; and wherein the U-shape LED tube further comprises lamp holders that fit the two ends of the U-shape tube body, and an integrated linkage is provided between the two lamp holders.

* * * * *